US010598126B2

(12) United States Patent
Hofbauer

(10) Patent No.: US 10,598,126 B2
(45) Date of Patent: Mar. 24, 2020

(54) FOUR-PROCESS CYCLE FOR A VUILLEUMIER HEAT PUMP

(71) Applicant: ThermoLift, Inc., Stony Brook, NY (US)

(72) Inventor: Peter Hofbauer, West Bloomfield, MI (US)

(73) Assignee: ThermoLift, Inc., Stony Brook, NY (US)

( * ) Notice: Subject to any disclaimer, the term of this patent is extended or adjusted under 35 U.S.C. 154(b) by 105 days.

(21) Appl. No.: 16/029,768

(22) Filed: Jul. 9, 2018

(65) Prior Publication Data

US 2018/0313296 A1 Nov. 1, 2018

Related U.S. Application Data

(63) Continuation-in-part of application No. 15/037,493, filed as application No. PCT/US2014/069098 on Nov. 18, 2014, now Pat. No. 10,030,893.

(60) Provisional application No. 61/907,268, filed on Nov. 21, 2013.

(51) Int. Cl.

| | |
|---|---|
| ***F02G 1/044*** | (2006.01) |
| ***F25B 30/02*** | (2006.01) |
| ***F02G 1/043*** | (2006.01) |

(52) U.S. Cl.

CPC ..... *F02G 1/0445* (2013.01); *F02G 1/0435* (2013.01); *F25B 30/02* (2013.01); *F02G 2250/18* (2013.01); *F02G 2280/60* (2013.01)

(58) Field of Classification Search

CPC .. F02G 1/0445; F02G 1/0435; F02G 2250/18; F02G 2280/60; F02G 2243/02; F02G 2280/10; F25B 30/00; F25B 30/02

See application file for complete search history.

(56) References Cited

U.S. PATENT DOCUMENTS

| | | | | |
|---|---|---|---|---|
| 1,275,507 A * | 8/1918 | Vuilleumier | ..... | F02G 1/04 62/6 |
| 2,567,454 A * | 9/1951 | Taconis | ..... | F25B 9/14 62/6 |
| 4,801,308 A | 1/1989 | Keefer | | |
| 5,301,506 A | 4/1994 | Pettingill | | |
| 5,483,802 A | 1/1996 | Kawajiri | | |

(Continued)

FOREIGN PATENT DOCUMENTS

| | | | |
|---|---|---|---|
| DE | 19502188 | C2 | 1/2016 |
| WO | 2013155258 | A1 | 10/2013 |

*Primary Examiner* — Ana M Vazquez

(74) *Attorney, Agent, or Firm* — Diana D. Brehob

(57) ABSTRACT

A four-process cycle is disclosed for a Vuilleumier heat pump that has mechatronically-controlled displacers. Vuilleumier heat pumps that use a crank to drive the displacers have been previously developed. However, mechatronic controls provides a greater degree of freedom to control the displacers. The four-process cycle provides a higher coefficient of performance than prior cycles in the crank-driven Vuilleumier heat pump and those previously disclosed for a mechatronically-driven Vuilleumier heat pump. The four-process cycle can be drawn out to provide a low demand condition by causing both displacers to remain stationary for a period of time. The four processes in which one of the displacers is commanded to move are separated by periods of inactivity in which both displacers remain stationary.

16 Claims, 7 Drawing Sheets

(56) References Cited

U.S. PATENT DOCUMENTS 5,615,556 A * 4/1997 Honda ..... F02G 1/0445
60/520
2016/0298878 A1 10/2016 Hofbauer

* cited by examiner

FOUR-PROCESS CYCLE FOR A VUILLEUMIER HEAT PUMP

FIELD OF INVENTION

The present disclosure relates to cycles in heat pumps, particularly Vuilleumier heat pumps.

BACKGROUND

Movement of displacers in most prior art Vuilleumier heat pumps are synchronized via a crank, such as shown in U.S. Pat. No. 1,275,507. A schematic of such a heat pump with crank-synchronized displacers is shown in FIG. 1. In the '507 patent, the displacers have a phase difference of 90 degrees as shown in FIG. 2. A mechatronically-driven Vuilleumier heat pump, which is commonly assigned to the assignee of the present disclosure, has been disclosed in WO 2013/155258. In such a heat pump, the displacers are independently actuated allowing one displacer to remain stationary while the other displacer moves, which provides many additional degrees of freedom in controlling displacer motion. In the WO 2013/155258 A1 publication, a three-process cycle is also disclosed. A cycle that provides a high coefficient of performance is desired. Furthermore, it is desirable to have a cycle that provides a high coefficient of performance at a range of demand levels, i.e., demand for heating or cooling.

In U.S. Pat. No. 5,301,506, a cycle is discussed for theoretical discussion purposes. "The thermodynamic operation . . . may be better understood with reference to the example discussed below of a machine having intermittent displacer motions." Later in the same paragraph: "It will be appreciated that, in practice, theoretically ideal conditions will not be obtainable." In the '506 reference, a thermodynamic analysis of a cycle in which displacer movement can be intermittent is analyzed. Because the inventor of the '506 reference has not contemplated an apparatus to provide such intermittent movement, the practicalities involved in operating such an apparatus are not considered.

SUMMARY

As discussed above, a three-process cycle was disclosed in WO 2013/155258 in which a mechanism to provide the three-process cycle was also disclosed. In U.S. Pat. No. 5,301,506, a four-process cycle was discussed in terms of being a thermodynamic cycle for the heat pump, but no mechanism to provide such a cycle was envisioned by the inventor. Because there was no mechanism and the discussion of a four-process cycle was purely theoretical, the U.S. Pat. No. 5,301,506 inventor was not concerned with practicalities to operate a device having the "theoretical" intermittent displacer. One such practicality is to provide a range of outputs. The ability to provide less than the maximum heating (or cooling) is sometimes called a turndown ratio or part load is not disclosed in either of such references. As discussed below, the heating (or cooling) level is controlled in the heat pump by holding both displacers stationary for a period of time between processes. The period of time that the displacers are stationary controls the output. Such output of the heat pump is based on a desired level of heating (or cooling) from an input signal from a thermostat and, in some cases, direct user input and/or other sensors. The disclosed heat pump can be used for heating or for cooling as the season demands.

A method to operate a heat pump is disclosed. The heat pump has a hot displacer adapted to reciprocate within a hot cylinder and a cold displacer adapted to reciprocate within a cold cylinder. The hot displacer has a remote position and a central position within the hot cylinder; and the cold displacer has a central position and a remote position within the cold cylinder. The method includes: actuating the hot displacer to move from its central position to its remote position within the hot cylinder; actuating the cold displacer to move from its central position to its remote position within the cold cylinder; actuating the hot displacer to move from its remote position to its central position within the hot cylinder; and actuating the cold displacer to move from its remote position to its central position within the cold cylinder wherein the actuations occur in the given order.

The hot and cold displacers both remain stationary for a first selectable dwell period between the actuating the hot displacer to move from its central position to its remote position within the hot cylinder and the actuating the cold displacer to move from its central position to its remote position within the cold cylinder. The first selectable dwell period is based on an input signal indicative of demand for one of heating and cooling.

The hot and cold displacers both remain stationary for a second selectable dwell period between the actuating the hot displacer to move from its remote position to its central position within the hot cylinder and the actuating the cold displacer to move from its remote position to its central position within the cold cylinder; the second selectable dwell period is based on the input signal.

The hot and cold displacers both remain stationary for a third selectable dwell period between the actuating the cold displacer to move from its remote position to its central position within the cold cylinder and the actuating the hot displacer to move from its central position to its remote position within the hot cylinder. The hot and cold displacers both remain stationary for a fourth selectable dwell period between the actuating the cold displacer to move from its central position to its remote position within the cold cylinder and the actuating the hot displacer to move from its remote position to its central position within the hot cylinder The actuating the hot displacer to move from its central position to its remote position comprises process one. The actuating the cold displacer to move from its central position to its remote position comprises process two. The actuating the hot displacer to move from its remote position to its central position comprises process three. The actuating the cold displacer to move from its remote position to its central position comprises process four. A cycle comprises: process one followed by process two followed by process three followed by process four. The process includes holding both displacers stationary for a second selectable period between process two and process three; holding both displacers stationary for a third selectable period between process three and process four; and holding both displacers stationary for a fourth selectable period between process four and process one.

Also disclosed is a heat pump having: a hot displacer disposed in a hot displacer cylinder; a cold displacer disposed in a cold displacer cylinder; a housing in which both the hot and cold displacer cylinders are located; a hot displacer actuator which when actuated causes the hot displacer to reciprocate between remote and central positions within the hot displacer cylinder; and a cold displacer actuator which when actuated causes the cold displacer to reciprocate between remote and central positions within the cold displacer cylinder. An input signal is provided that is indicative of the demand for one of heating and cooling. During heating season, the demand is for heating and during the cooling season, the demand is for cooling. The heat pump also has an electronic control unit (ECU) receiving the input signal and coupled to the hot displacer actuator and the cold displacer actuator. The ECU commands the hot displacer and cold displacers to move through a series of arrangements: a first arrangement in which the hot displacer is at its central position within the hot displacer cylinder and the cold displacer is proximate its central position with the cold displacer cylinder; a second arrangement in which the hot displacer is at its remote position within the hot displacer cylinder and the cold displacer is proximate its central position with the cold displacer cylinder; a third arrangement in which the hot displacer within the hot displacer cylinder is at its remote position and the cold displacer is proximate its remote position within the cold displacer cylinder; and a fourth arrangement in which the hot displacer is at its central position within the hot displacer cylinder and the cold displacer is proximate its remote position within the cold displacer cylinder. The ECU determines a first period of time to command the hot and cold displacers to remain stationary between the first and second arrangements. The ECU bases the period of time on the input signal.

A cycle comprises moving from the first arrangement to the second arrangement to the third arrangement to the fourth arrangement to the first arrangement. The hot displacer remains stationary in its remote position for at least a portion of the time that it takes the cold displacer to move from its central position to its remote position; and, the hot displacer remains stationary in its central position for at least a portion of the time that it takes the cold displacer to move from its remote position to its central position.

In some embodiments, central axis of the cold displacer cylinder is collinear with a central axis of the hot displacer cylinder.

In some embodiments, diameter of the hot displacer cylinder is greater than a diameter of the cold displacer cylinder.

In some embodiments, a distance that the hot displacer moves from its remote position to its central position is greater than a distance that the cold displacer moves from it remote position to its central position.

A time that it takes for the hot displacer to move between its central and remote positions is shorter than a time that it takes for the cold displacer to move between its central and remote positions.

Also disclosed is a heat pump having: a hot displacer disposed in a hot displacer cylinder; a cold displacer disposed in a cold displacer cylinder, the hot displacer cylinder and the cold displacer cylinder being coupled together; a hot displacer actuator which when actuated causes the hot displacer to reciprocate between remote and central positions within the hot displacer cylinder; and a cold displacer actuator which when actuated causes the cold displacer to reciprocate between remote and central positions within the cold displacer cylinder. The heat pump also has an electronic control unit (ECU) electronically coupled to the hot displacer actuator and the cold displacer actuator and an input signal indicating demand for one of heating and cooling, the input signal provided to the ECU. ECU actuation of the hot displacer to move from its central position to its remote position comprises process one. ECU actuation of the cold displacer to move from its central position to its remote position comprises process two. ECU actuation of the hot displacer to move from its remote position to its central position comprises process three. ECU actuation of the cold displacer to move from its remote position to its central position comprises process four. A cycle comprises: process one followed by process two followed by process three followed by process four. The ECU commands both displacers to remain stationary for a first period of time between processes one and two. The ECU commands both displacer to remain stationary for a second period of time between processes three and four. The first and second periods of time are based on the input signal.

The cycle comprises: process one followed by process two followed by process three followed by process four followed by process one. The ECU commands both displacers to remain stationary for a third period of time between processes two and three. The ECU commands both displacer to remain stationary for a fourth period of time between processes four and one.

The heat pump includes a cold displacer linear actuator coupled to the cold displacer and a hot displacer linear actuator coupled to the hot displacer. The cold displacer linear actuator comprises: a cold displacer shaft coupled between the cold displacer and a cold displacer armature, a first coil disposed within the heat pump at a first axial location and a second coil disposed within the heat pump at a second axial location. The hot displacer linear actuator comprises: a hot displacer shaft coupled between the hot displacer and a hot displacer armature, a third coil disposed within the heat pump at a third axial location and a fourth coil disposed within the heat pump at a fourth axial location. The heat pump also includes a power electronics module electrically coupled to the first, second, third, and fourth coils. The power electronics module is electronically coupled to the ECU. The ECU commands the electronics module to provide current to the first, second, third, and fourth coils to move the hot and cold displacers. The hot displacer linear actuator further comprises a hot displacer spring system coupled between a first stationary element in the heat pump and the hot displacer. The cold displacer linear actuator further comprises a cold displacer spring system coupled between a second stationary element in the heat pump and the cold displacer. When the ECU's command to the first coil releases the cold displacer from its remote position, the cold displacer spring system causes the cold displacer to move from its remote position toward its central position. When the ECU's command to the second coil releases the cold displacer from its central position, the cold displacer spring system causes the cold displacer to move from its central position toward its remote position. When the ECU's command to the third coil releases the hot displacer from its remote position, the hot displacer spring system causes the hot displacer to move from its remote position toward its central position. When the ECU's command to the fourth coil releases the hot displacer from its central position, the hot displacer spring system causes the hot displacer to move from its central position toward its remote position.

In some embodiments, a thermostat is electronically coupled to the ECU. The input signal comes from the thermostat.

The heat pump further includes at least one temperature sensor electronically coupled to the ECU wherein the ECU further bases the first and second periods of time on data from the at least one temperature sensor.

The input signal is provided to the ECU by one of: electronic coupling and wirelessly.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
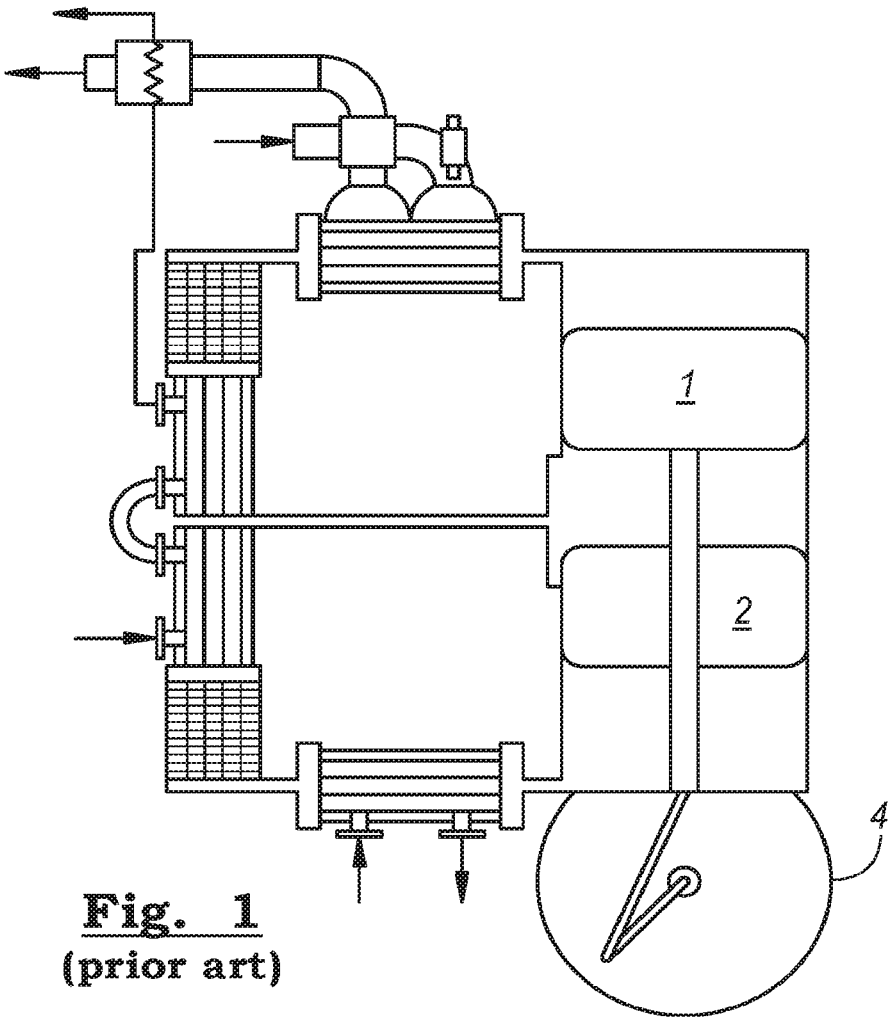
Fig. 1 (prior art)
FIG. 1 is a schematic of a prior art Vuilleumier heat pump.
Figure 2:
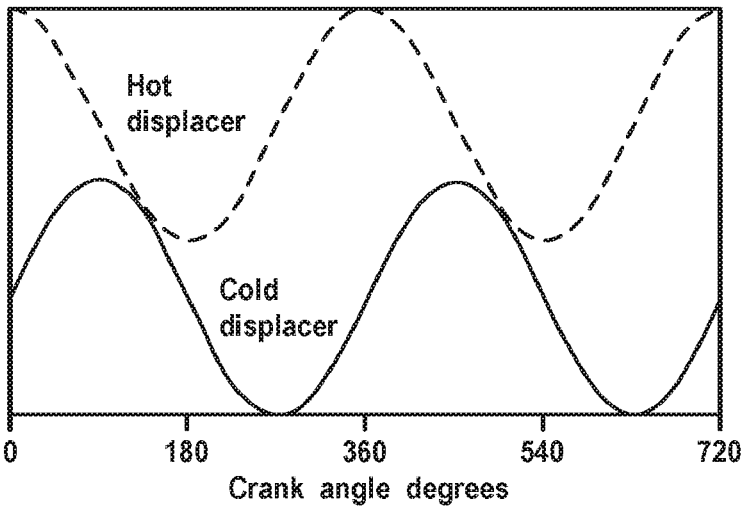
Fig. 2 (prior art)
FIG. 2 is a graph of displacer movement in the Vuilleumier heat pump with crank-driven displacers.
Figure 3:
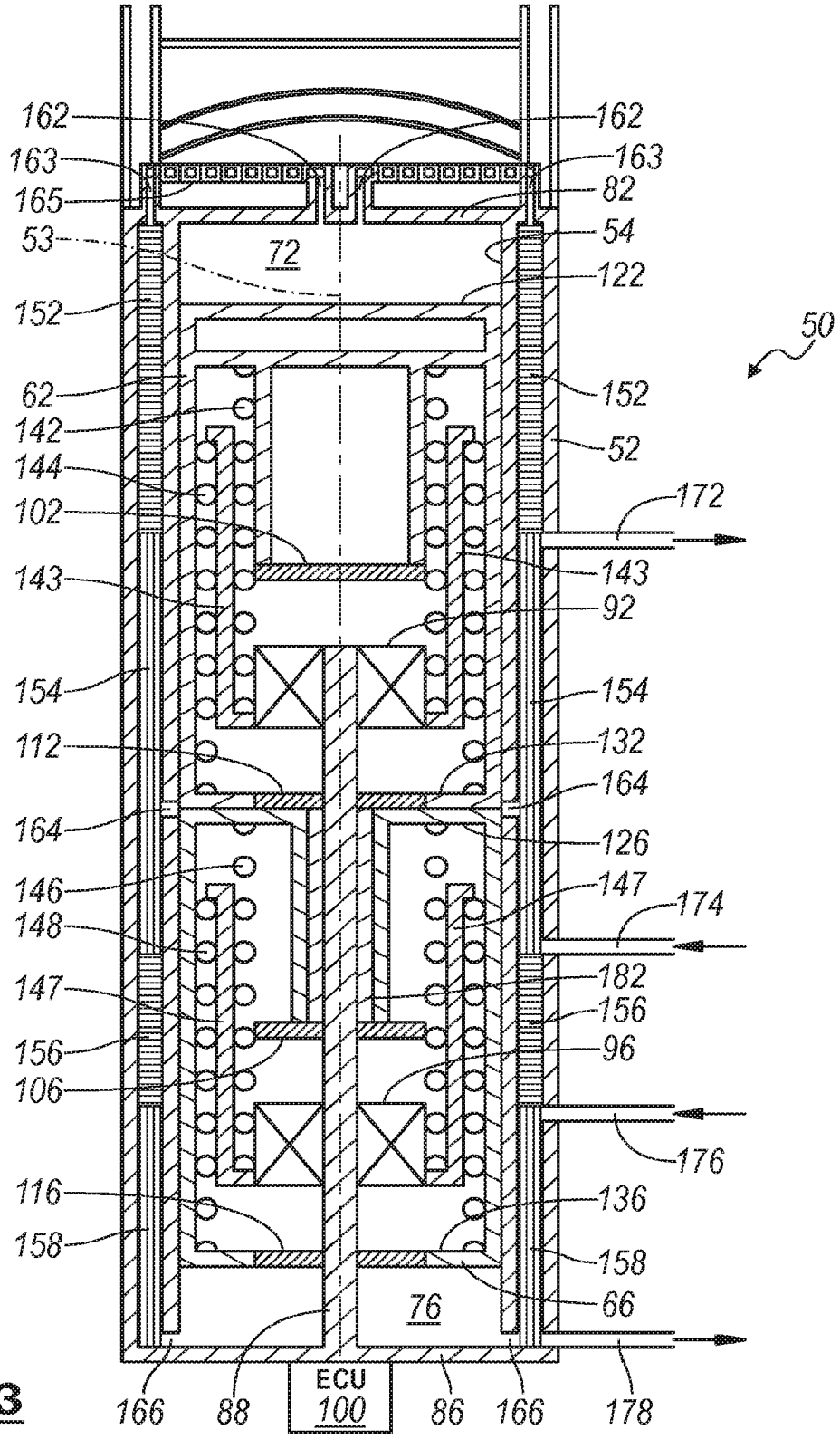
FIG. 3 is a schematic representation of a Vuilleumier heat pump with mechatronically-controlled displacers.
Figure 6:
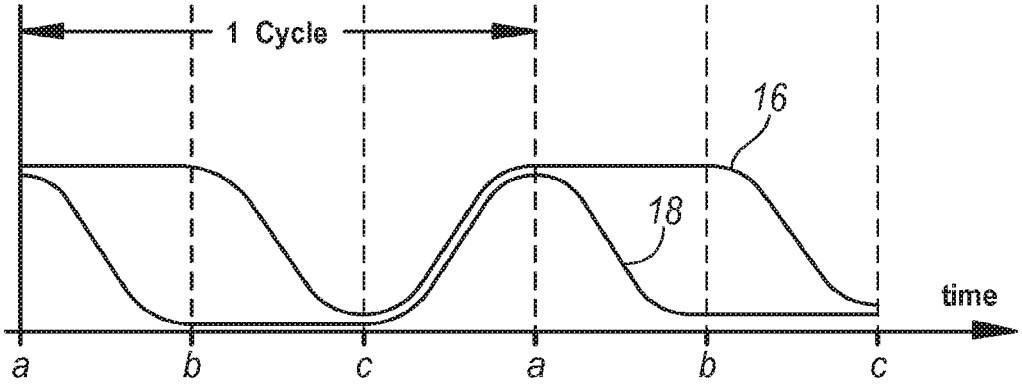
FIG. 6 is a chart showing movement of the hot and cold displacers as a function of time for a three-process cycle.

Before describing cycles that are facilitated by a mechatronically-actuated Vuilleumier heat pump, a non-limiting example of such a heat pump 50 is shown in FIG. 3. Heat pump 50 has a housing 52 and a cylinder 54 into which hot displacer 62 and cold displacer 66 are disposed. Displacers 62 and 66 reciprocate within cylinder liner 54 moving along central axis 53. An actuator for hot displacer 62 includes: ferromagnetic blocks 102 and 112, electromagnet 92, springs 142 and 144, and a support structure 143. Support structure 143, as shown in FIG. 6 is attached to the electromagnet 92, which is coupled to a central post 88 that is coupled to a cold end 86 of housing 52. Post 88, electromagnet 92, and support structure 143 are stationary. When hot displacer 62 reciprocates upward from the position shown in FIG. 6, spring 142 is compressed to a greater degree than its equilibrium preload and 144 is under a lower compression. Electromagnet 92 is energized to pull ferromagnetic block 102 or 112 toward it, against the spring forces of springs 142 and 144. Analogously, cold displacer 66 has a cold actuator that includes: an electromagnet 96 coupled to post 88, a support structure 147 coupled to electromagnet 96, and springs 146 and 148. Spring 146 is coupled between support structure 147 and a first cap 126 of cold displacer 66. Spring 148 is coupled between support structure 147 and a second cap 136 of cold displacer 66. Electromagnets 92 and 96 are controlled via an electronic control unit (ECU) 100.

Ferromagnetic blocks 102, 112, 106, and 116 are coupled to: a standoff associated with a first cap 122 of hot displacer 62, a second cap 132 of hot displacer 62, a standoff associated with first cap 126 of cold displacer 66, and second cap 136 of cold displacer 66, respectively. Openings are provided in second cap 132 of hot displacer 62, and first and second caps 126 and 136 of cold displacer 66 to accommodate post 88 extending upwardly through cold displacer 66 and into hot displacer 62.

An annular chamber is formed between a portion of the inner surface of housing 52 and the outer surface of cylinder 54. A hot recuperator 152, a warm heat exchanger 154, a cold recuperator 156, and a cold heat exchanger 158 are disposed within the annular chamber. Openings through cylinder 54 allow fluid to pass between the interior of cylinder 54 to the annular chamber. Openings 166 allow for flow between a cold chamber 76 and cold heat exchanger 158 in the annular chamber. Openings 164 allow flow between a warm chamber and the annular chamber. Heat pump 50 also has a hot heat exchanger 165 that is provided near a hot end of housing 52. Openings 162 through cap 82 lead to heat exchanger 165 which has passages 163 which lead to the annular chamber. Hot heat exchanger 165 may be associated with a burner arrangement or other energy source. A fluid that is to be heated flows to warm heat exchanger 154 into opening 174 and out opening 172, cross flow. Fluid that is to be cooled flows to cold heat exchanger 158 in at opening 176 and exits at opening 178. The flow through the heat exchangers may be reversed, parallel flow.

Figure 4:
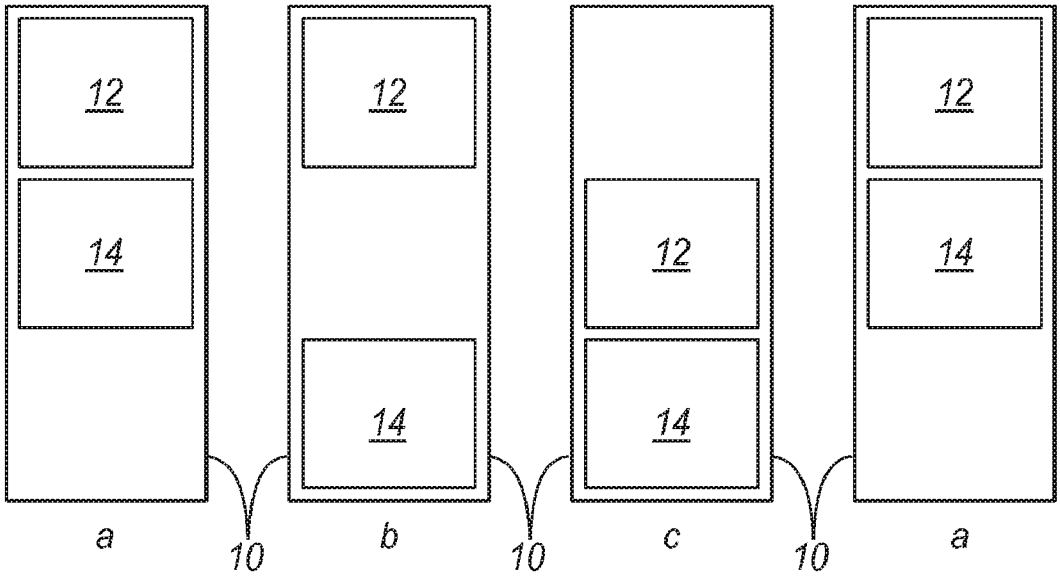
FIG. 4 is a representation of a three-process cycle in the Vuilleumier heat pump.

The end positions of the displacers in a three-process cycle in the Vuilleumier heat pump are illustrated in FIG. 4. At state 'a', both a hot displacer 12 and a cold displacer 14 are at their upper positions within a cylinder 10. In state 'b' in FIG. 3, cold displacer 14 moves to its lower position. A change from state 'a' to state 'b' is a first process. From state 'b' to state 'c', hot displacer 12 moves from its upper to its lower position, i.e., a second process. In moving from state 'c' back to state 'a', both hot displacer 12 and cold displacer 14 move upwards, which is a third process.

In the cycle illustrated in FIG. 4, hot displacer 12 and cold displacer 14 are in a central space within cylinder 10 at different points in the cycle. That is, at state 'a', cold displacer 14 is in the central space in cylinder 10 and at state 'c', hot displacer 12 is in the central space in cylinder 10. The heat pump in FIG. 3 is suitable for a three-process cycle. A heat pump that would allow a four-process cycle is similar to that in FIG. 3, except that the cylinder is elongated, the reason for which will become clear from the discussion below.

Figure 5:
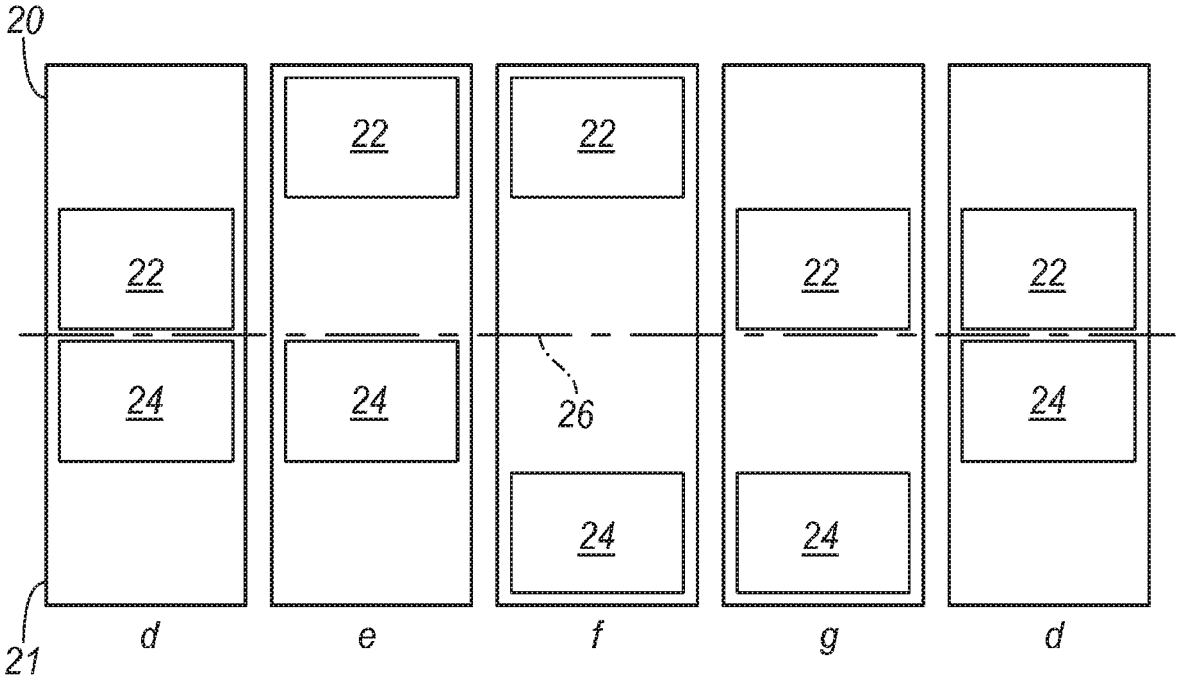
FIG. 5 is a representation of a four-process cycle in the Vuilleumier heat pump.

A four-process cycle for use in a Vuilleumier heat pump is shown in FIG. 5 in which a hot displacer 22 reciprocates within a hot displacer cylinder 20 and a cold displacer 24 reciprocates with a cold displacer cylinder 21. At state 'd', a hot displacer 22 is at its central position within cylinder 20 and a cold displacer 24 is at its central position within cylinder 21. In going from state 'd' to state 'e', hot displacer 22 moves to its remote position within cylinder 20. This is a first process or process one. In going from state 'e' to 'f', cold displacer 24 moves to its remote position within cylinder 21. This is a second process or process two. From state 'f' to 'g', hot displacer 22 moves to its central position within cylinder 20; a third process or process three. In moving from state 'g' to back to state 'd', cold displacer 24 moves to its central position within cylinder 21, undergoing a fourth process or process four.

As discussed above, in the three-process cycle in FIG. 4, hot displacer 12 and cold displacer 14 occupy the same space but, of course, at different times during the cycle. In the four-process cycle of FIG. 5, hot displacer 22 and cold displacer 24 do not cross a center line 26. Cylinders 20 and 21 are collinear and of the same diameter and are denoted by cylinder 20 being above center line 26 and cylinder 21 being below center line 26.

The displacer movement end positions illustrated in FIG. 4 are shown as a function of time in FIG. 6. The movement of the lower edge of the hot displacer is shown as curve 16. The movement of the upper edge of the cold displacer is shown as curve 18. The cold displacer moves downward in going from state 'a' to state 'b' while the hot displacer is stationary. From 'b' to 'c', the hot displacer moves downward while the cold displacer is stationary. And from 'c' to 'a', which completes the cycle, both displacers move upward.

Figure 7:
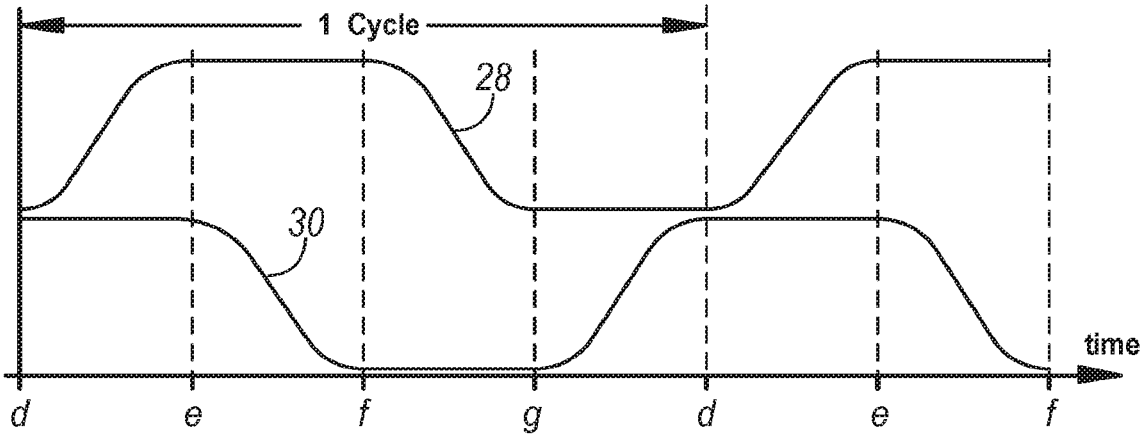
FIG. 7 is a chart showing movement of the hot and cold displacers as a function of time for a four-process cycle.

The displacer movement end positions illustrated in FIG. 5 are shown as a function of time in FIG. 7. The lower edge of the hot displacer is plotted as curve 28 and the upper edge of the cold displacer is plotted as curve 30. At state 'd', the displacers are both in their central positions and proximate each other. From state 'd' to state 'e', the cold displacer remains stationary and the hot displacer moves upward. From 'e' to 'f', the hot displacer remains stationary and the cold displacer moves downward. From 'f' to 'g', the hot displacer moves downward and the cold displacer remains stationary. From 'g' to return to the starting position 'd', the hot displacer remains stationary and the cold displacer moves upward. The cycle in FIG. 6 is completed in three processes and the cycle in FIG. 7 is completed in four processes. Thus, if the displacers move at the same speed in the cycle in FIG. 6 as in FIG. 7, the cycle in FIG. 7 takes longer, about 1⅓ times longer to complete than the cycle in FIG. 6 when the displacers have the same dynamics.

Figure 8:
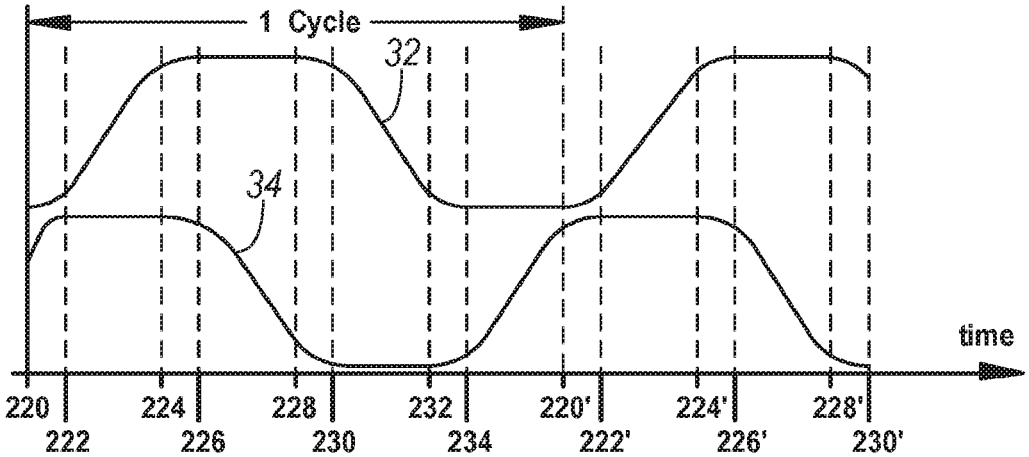
FIG. 8 is a chart showing movement of the hot and cold displacers as a function of time for a four-process cycle in which movement of the displacers overlap.

An alternative to the cycle in FIG. 7 is a cycle shown in FIG. 8 in which the movements of the displacers overlap slightly. The upper edge of the hot displacer movement is illustrated by curve 32; the lower edge of the cold displacer is illustrated by curve 34. At time 220 in FIG. 8, the cold displacer is finishing its upward movement and the hot displacer is starting its upward movement. At time 222, the cold displacer has attained its upper position (its remote position) and remains there until time 224. At time 224, the hot displacer has not yet arrived at the upper position (its remote position), which happens at time 226. Meanwhile, the cold displacer finishes the upward travel during time 224 to 226. The hot displacer is stationary at its upper position from 226 to 228. The cold displacer completes the downward travel at time 230 and then stays at the lower position until time 232. Meanwhile, the hot displacer moves downwardly from time 228 through time 234. At time 232, the cold displacer moves upwardly through time 234, time 220', and time 222'. The hot displacer remains stationary from time 234 through time 220'. At time 220', a complete cycle has been completed; the positions of the displacers are the same at time 220 as at time 220'.

The rate at the displacers move is determined by the spring constants and other properties of the system. As the illustrations in FIGS. 7 and 8 refer to the same configuration, the displacers move at the same rate in FIGS. 7 and 8. However, because movement in the hot displacer is initiated before the cold displacer attains its extreme position and vice versa in the cycle shown in FIG. 8, the FIG. 8 cycle occurs in less time than that in FIG. 7. Such a cycle provides a higher output.

Figure 9:
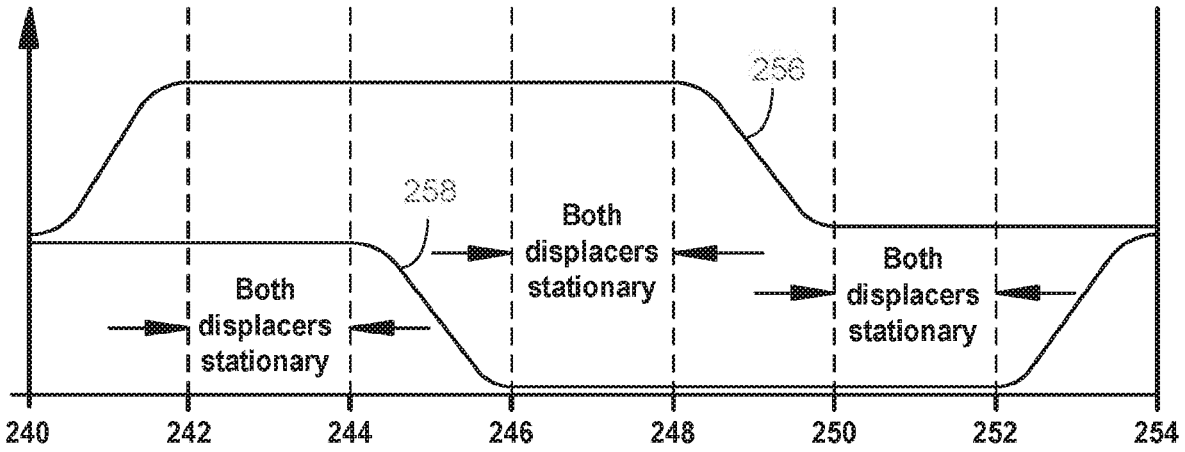
FIG. 9 is a chart showing movement of the hot and cold displacers in which there are periods in which both displacers remain stationary.

The discussion of cycles in regards to FIGS. 6-8 describe the highest output cycles that are possible. To obtain a downturn in output, both displacers remain stationary for a period between portions of the cycle. An example of such displacer movement is shown in FIG. 9. The hot displacer movement is shown as curve 256 and the cold displacer movement is shown as curve 258. At time 240, both displacers are in their central positions within their cylinders. The hot displacer moves upward between time 240 and time 242. Both displacers are stationary between time 242 and time 244. The duration can be shorter or longer than that shown in FIG. 9. Other intervals during which both displacers are stationary are between time 246 and time 248 and between time 250 and time 252. Again, these can be shorter or longer to meet demanded output. Furthermore, the interval during which the displacers may be different in different parts of the cycle. E.g., the interval between time 242 and time 244 when the hot displacer is at its remote position and the cold displacer is at its central position can be of a different length than either of the other intervals: time 246 to time 248 or time 250 to time 252.

Figure 10:
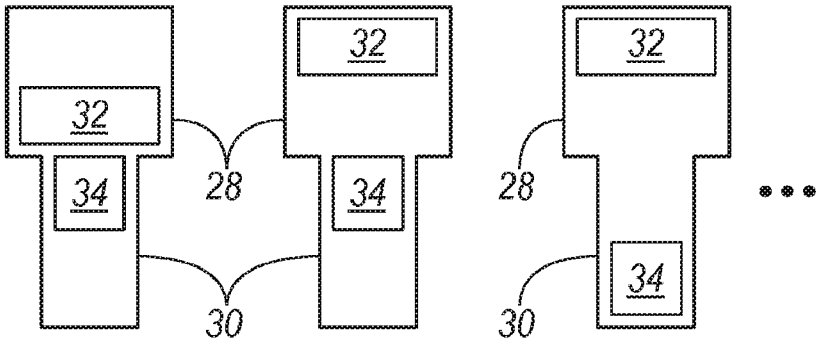
FIG. 10 is a representation of a Vuilleumier heat pump in which the diameter of the hot displacer cylinder is greater than the diameter of the cold displacer cylinder.
Figure 11:
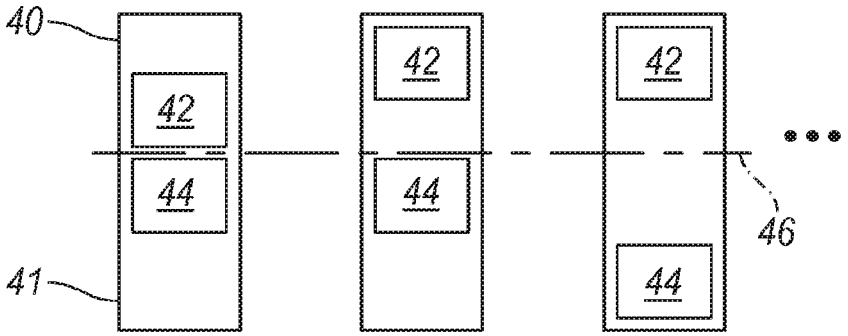
FIG. 11 is a representation of a Vuilleumier heat pump in which the stroke of the hot displacer is less than the stroke of the cold displacer.

A Vuilleumier heat pump in which the diameters of the cylinders are different is shown in FIG. 10. A hot displacer cylinder 28 has a greater diameter than cold displacer cylinder 30. A hot displacer 32 that reciprocates within hot displacer cylinder 28 is also greater than cold displacer 34 that reciprocates within cold displacer cylinder 32. A heat pump in which the strokes are different is shown in FIG. 11. A hot displacer cylinder 40 has a hot displacer 42; and a cold displacer cylinder 41 has a cold displacer 44. The stroke of hot displacer 42 is less than the stroke of cold displacer 44.

Figure 12:
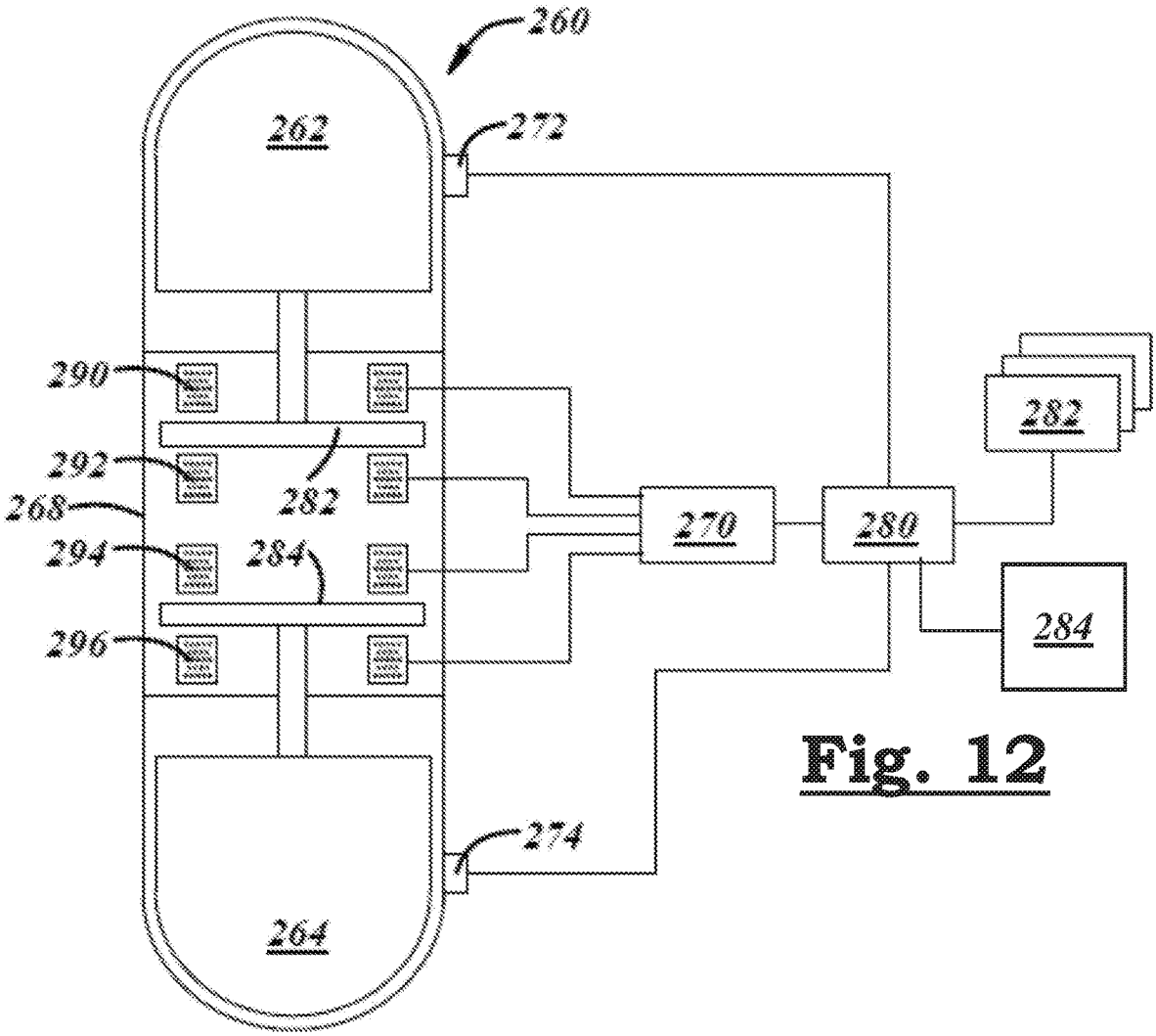
FIG. 12 is schematic of the linear motor part of the linear actuation system of one embodiment of a heat pump showing control electronics.

In FIG. 12, more details of the thermodynamic apparatus 260 showing the power electronics used to control the displacers. Thermodynamic apparatus 260 (or Vuilleumier heat pump) has a hot displacer 262 and a cold displacer 264. A linear actuator section 268 is located between displacers 260 and 262. Coils 290, 292, 294, and 296 are housed in housing 268. Hot displacer 262 couples to an armature 282 via a shaft; cold displacer 264 couples to an armature 284 via a shaft. A power electronics module 270 is electrically coupled to coils 290, 292, 294, and 296. Power electronics module provides the current to coils 290, 292, 294 and 296. An electronic control unit 280 electronically coupled to power electronics module 270 provides control signals to the power electronics module 270 to control the pulses of current to coils 290, 292, 294, and 296. ECU 280 determines the desired current to send to the coils based on at least one of: demanded heating or cooling output from a user (often a thermostat) 284, a signal from a position sensor 272 associated with hot displacer 262, a signal from a position sensor 274 associated with cold displacer 264, and other sensors 282, which may include sensors for determining ambient conditions such as temperature and humidity and temperature and pressure sensors within the heat pump. User demand is often in the form of a thermostat which the user adjusts to indicate a desired temperature for a living or working space. When the temperature within a building is lower than the desired temperature in a season in which heating is typical, then the thermostat 284 demands a greater amount of heating. Or during cooling season, when the temperature is greater than a requested temperature by more than a certain amount, then thermostat 284 sends a signal to heat pump 260 to provide a greater amount of cooling.

Thermostat 284 and other sensors 282 can provide signals to the ECU by electronic coupling, wirelessly, or any suitable path.

Figure 13:
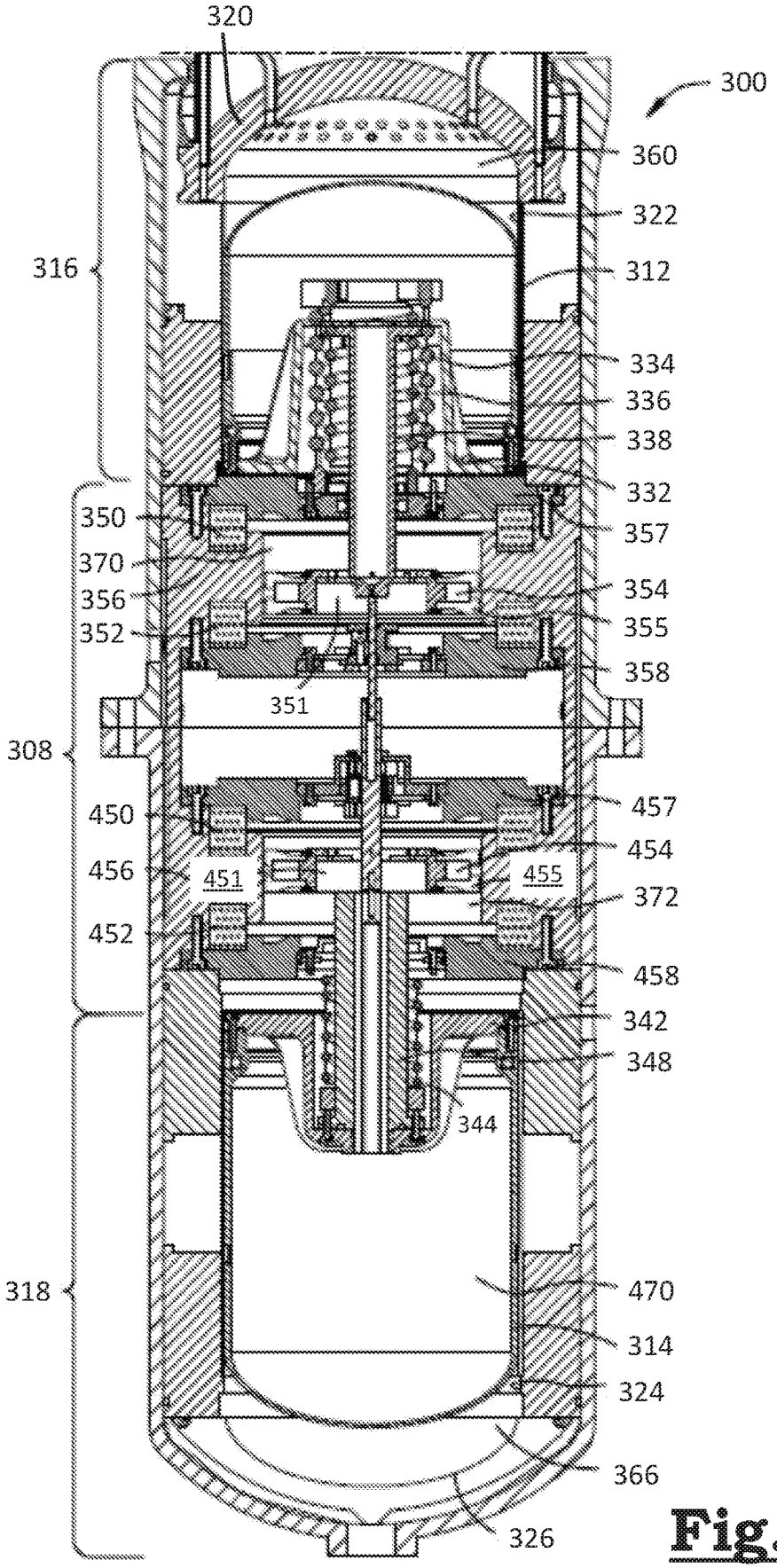
FIG. 13 is a schematic of one embodiment of a heat pump in which the linear actuation system is centrally located between the displacers.

In FIG. 13, a heat pump 300 has a hot displacer section 316 which includes a hot displacer 312 that reciprocates within a hot displacer cylinder 322. Heat pump 300 also has a cold displacer section 318 which includes a cold displacer 314 that reciprocates within a cold displacer cylinder 324. Not illustrated for the sake of clarity is a burner section or other energy input section that sits above the hot displacer section.

Hot displacer 312 is actuated by a linear actuator which includes coils 350 and 352 that are within a back iron 356. Hot displacer 312 is coupled via a shaft 338 to an armature, which includes a permanent magnet 354, pole pieces 355 that sandwich magnet 354, and a disk 351. In some alternatives, element 354 is a ferromagnetic material, one which is attracted when subjected to a magnetic field, yet largely unmagnetized when there is no such electric field. When coil 350 is energized, the armature is pulled upward thereby moving hot displacer 312 upward; when coil 352 is energized, hot displacer 312 moves downwards. That actual movement is more complicated than described when element 354 is a permanent magnet because the magnet 354 is attracted when the current flow is in one direction in the coil (either 350 or 352) and is repelled when the current flow is in the opposite direction. If the energy to move hot displacer 312 between its ends of travel were supplied solely from energizing coils, the electrical energy draw would require too great thereby seriously impairing the overall efficiency of heat pump 300. To provide much of the force to move hot displacer 312, springs 334 and 336 are disposed between hot displacer 312 and linear motor section 308, i.e., the section of the chamber with coils and the magnets. Alternatively, springs 334 and 336 couples or abuts to any stationary element within heat pump 300. In the embodiment in FIG. 13, the springs are in tension when hot displacer 312 is at its upper position (farthest away from linear motor section 308) and in compression when hot displacer 312 is at its lower position. Consequently, springs 334 and 336 bias hot displacer 312 toward a position near the middle of travel and provide much of the force for hot displacer 312 to move from end to end. Current to coils 350 and 352 are activated to draw hot displacer 312 to complete the stroke and to control the rate of approach of hot displacer 312 when approaching the end of travel.

A similar mechatronics system is provided for cold displacer 314 with coils 450 and 452 that are energized to act upon an armature that includes a permanent magnet 454 in a back iron 456. The armature (including permanent magnet 454, pole pieces 455, and disk 451) is coupled to cold displacer 314 via a shaft 348. A spring 348 is disposed between cold displacer 314 and a stationary element of heat pump 300, linear motor section 308 of heat pump 300 in the present embodiment.

The upper linear motor in FIG. 13 is delimited by end plates 357 and 358, which also serve as back irons. The lower linear motor is delimited by end plates 457 and 458, which also serve as back irons. End plate 357 and end plate 458 delimit linear motor section 308 from the rest of heat pump 300. In operation, shaft 338, along with displacer 312 and the armature coupled to shaft 338, reciprocates. An orifice is provided in end plate 357 to accommodate shaft 338; and, shaft 348 reciprocates through an orifice defined in end plate 458.

A hot chamber 360 is defined by an upper dome 320, hot displacer cylinder 322, and a top of hot displacer 312. In FIG. 13, hot displacer 312 is in its lowest position, in which there is almost no volume in a hot-warm chamber. The hot-warm chamber is defined by linear motor section 8, a bottom of hot displacer 312 and hot displacer cylinder 322. A cold chamber 366 is defined by a lower dome 324, cold displacer cylinder 326, and a lower end of cold displacer 314. Cold displacer 314 is shown in its most upward position. Thus, a cold-warm chamber is not visible in FIG. 13. The cold-warm chamber is defined by linear motor section 308, a top of cold displacer 314, and cold displacer cylinder 324.

In addition to the springs 334, 336, and 344, a gas spring is provided between displacers 312 and 314. Volume within the gas spring includes volumes 370 and 372 within linear motor section 308 and an interior volume 470 within cold displacer 314. Linear motor section 308 has gas-filled volumes 370 and 372 that move depending on where on the position of the armatures. The total volume contained within the gas spring depends on the position of hot displacer 312, at least, due to shaft 338 displacing gases when reciprocating within volume 370.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

I claim:

1. A method to operate a heat pump, the heat pump having a hot displacer adapted to reciprocate within a hot cylinder and a cold displacer adapted to reciprocate within a cold cylinder wherein the hot displacer has a remote position and a central position within the hot cylinder and the cold displacer has a central position and a remote position within the cold cylinder, the method comprising:

actuating the hot displacer to move from its central position to its remote position within the hot cylinder;

actuating the cold displacer to move from its central position to its remote position within the cold cylinder;

actuating the hot displacer to move from its remote position to its central position within the hot cylinder; and actuating the cold displacer to move from its remote position to its central position within the cold cylinder wherein the actuations occur in the given order, wherein:

the hot and cold displacers both remain stationary for a selectable dwell period between the actuating the hot displacer to move from its central position to its remote position within the hot cylinder and the actuating the cold displacer to move from its central position to its remote position within the cold cylinder; and the selectable dwell period is based on an input signal indicative of demand for one of heating and cooling.

2. The method of claim 1 wherein:

the selectable dwell period is a first selectable dwell period;

the hot and cold displacers both remain stationary for a second selectable dwell period between the actuating the hot displacer to move from its remote position to its central position within the hot cylinder and the actuating the cold displacer to move from its remote position to its central position within the cold cylinder; and the second selectable dwell period is based on the input signal.

3. The method of claim 2 wherein:

the hot and cold displacers both remain stationary for a third selectable dwell period between the actuating the cold displacer to move from its remote position to its central position within the cold cylinder and the actuating the hot displacer to move from its central position to its remote position within the hot cylinder; and the hot and cold displacers both remain stationary for a fourth selectable dwell period between the actuating the cold displacer to move from its central position to its remote position within the cold cylinder and the actuating the hot displacer to move from its remote position to its central position within the hot cylinder.

4. The method of claim 1 wherein:

the actuating the hot displacer to move from its central position to its remote position comprises process one;

the actuating the cold displacer to move from its central position to its remote position comprises process two;

the actuating the hot displacer to move from its remote position to its central position comprises process three;

the actuating the cold displacer to move from its remote position to its central position comprises process four;

a cycle comprises: process one followed by process two followed by process three followed by process four; and the selectable dwell period is a first selectable dwell period, the method further comprising at least one of:

holding both displacers stationary for a second selectable dwell period between process two and process three;

holding both displacers stationary for a third selectable dwell period between process three and process four; and holding both displacers stationary for a fourth selectable dwell period between process four and process one.

5. A heat pump, comprising:

a hot displacer disposed in a hot displacer cylinder, the hot displacer has a remote position and a central position within the hot displacer cylinder;

a cold displacer disposed in a cold displacer cylinder, the cold displacer has a remote position and a central position within the cold displacer cylinder; and a housing in which both the hot and cold displacer cylinders are located;

wherein:

the hot displacer and the cold displacer move through a series of arrangements:

a first arrangement in which the hot displacer is at its central position within the hot displacer cylinder and the cold displacer is proximate its central position with the cold displacer cylinder;

a second arrangement in which the hot displacer is at its remote position within the hot displacer cylinder and the cold displacer is proximate its central position with the cold displacer cylinder;

a third arrangement in which the hot displacer within the hot displacer cylinder is at its remote position and the cold displacer is proximate its remote position within the cold displacer cylinder;

a fourth arrangement in which the hot displacer is at its central position within the hot displacer cylinder and the cold displacer is proximate its remote position within the cold displacer cylinder;

the hot and cold displacers remain stationary between the first and second arrangements for a predetermined time.

6. The heat pump of claim 5 wherein:

a cycle comprises moving from the first arrangement to the second arrangement to the third arrangement to the fourth arrangement to the first arrangement;

the hot displacer remains stationary in its remote position for at least a portion of the time that it takes the cold displacer to move from its central position to its remote position; and the hot displacer remains stationary in its central position for at least a portion of the time that it takes the cold displacer to move from its remote position to its central position.

7. The heat pump of claim 5 wherein a central axis of the cold displacer cylinder is collinear with a central axis of the hot displacer cylinder.

8. The heat pump of claim 5 wherein a diameter of the hot displacer cylinder is greater than a diameter of the cold displacer cylinder.

9. The heat pump of claim 5 wherein a distance that the hot displacer moves from its remote position to its central position is greater than a distance that the cold displacer moves from its remote position to its central position.

10. The heat pump of claim 5 wherein a time that it takes for the hot displacer to move between its central and remote positions is shorter than a time that it takes for the cold displacer to move between its central and remote positions.

11. The heat pump of claim 5, further comprising:

a hot displacer actuator which when actuated causes the hot displacer to reciprocate between a remote and a central position within the hot displacer cylinder;

a cold displacer actuator which when actuated causes the cold displacer to reciprocate between a remote and a central position within the cold displacer cylinder;

an electronic control unit (ECU) coupled to the hot displacer actuator and the cold displacer actuator; and an input signal indicative of a demand for one of heating and cooling, the input signal being provided to the ECU, wherein:

the hot displacer linear actuator comprises: a first ferromagnetic block, a first electromagnet, first and second springs, and a first support structure;

the first electromagnet is coupled to the first support structure which is in turn indirectly coupled to the housing;

the first ferromagnetic block is indirectly coupled to the hot displacer;

the cold displacer linear actuator comprises: a second ferromagnetic block, a second electromagnet, third and fourth springs, and a second support structure;

the second electromagnet is coupled to the second support structure which is in turn indirectly coupled to the housing;

the second ferromagnetic block is indirectly coupled to the cold displacer; and the first and second electromagnets are electronically coupled to the ECU, the ECU commands the movement of the hot and cold displacers via commands to the first and second electromagnets;

the ECU determines the predetermined time to command the hot and cold displacers to remain stationary between the first and second arrangements; and the ECU bases the predetermined time on the input signal.

12. A method to operate a heat pump, wherein:

the heat pump has a housing having: a hot displacer cylinder and a cold displacer cylinder disposed therein;

the hot displacer cylinder has a hot displacer disposed therein with the hot displacer having a central position and a remote position within the hot displacer cylinder;

the cold displacer cylinder has a cold displacer disposed therein with the cold displacer having a central position and a remote position with the cold displacer cylinder, the method comprising:

commanding the hot displacer to move from its central position to its remote position within the hot cylinder which comprises process one;

commanding the cold displacer to move from its central position to its remote position within the cold cylinder which comprises process two;

commanding the hot displacer to move from its remote position to its central position within the hot cylinder which comprises process three; and commanding the cold displacer to move from its remote position to its central position within the cold cylinder which comprises process four, wherein:

a cycle comprises process one followed by process two followed by process three followed by process four, the method further comprising:

commanding the hot and cold displacers to both remain stationary for a selectable dwell period between the first and second process.

13. The method of claim 12 wherein the selectable dwell period is based on an input signal indicative of demand for one of heating and cooling.

14. The method of claim 12 wherein the selectable dwell period is a first selectable dwell period, the method further comprising:

commanding the hot and cold displacers to both remain stationary for a second selectable dwell period between processes two and three.

15. The method of claim 12 wherein the selectable dwell period is a first selectable dwell period, the method further comprising:

commanding the hot and cold displacers to both remain stationary for a second selectable dwell period between processes three and four.

16. The method of claim 12 wherein the selectable dwell period is a first selectable dwell period, the method further comprising:

commanding the hot and cold displacers to both remain stationary for a second selectable dwell period between processes four and one.

* * * * *